US005765578A

United States Patent [19]

Brandt et al.

[11] Patent Number: 5,765,578

[45] Date of Patent: Jun. 16, 1998

[54] CARBON DIOXIDE JET SPRAY POLISHING OF METAL SURFACES

[75] Inventors: Elwood Steven Brandt, Rochester; Brian A. Simpson, North Chili, both of N.Y.

[73] Assignee: Eastman Kodak Company, Rochester, N.Y.

[21] Appl. No.: 654,943

[22] Filed: May 29, 1996

[51] Int. Cl.[6] ..... B08B 3/02

[52] U.S. Cl. ..... 134/7; 134/37

[58] Field of Search ..... 134/3, 7, 37, 41, 134/42

[56] References Cited

U.S. PATENT DOCUMENTS

| | | | |
|---|---|---|---|
| 4,806,171 | 2/1989 | Whitlock et al. | 134/7 |
| 4,867,799 | 9/1989 | Grebinski | 134/11 |
| 5,344,494 | 9/1994 | Davidson et al. | 134/7 |
| 5,470,154 | 11/1995 | Nishizawa et al. | 134/11 |

OTHER PUBLICATIONS

"Cleaning of Mineral Quarry UGT Samples by $CO_2$ Jet Spray", Hughes Aircraft Company, Sponsored by Strategic Defense Initiative Office, Final Technical Report, RL-TR-91-174, Aug. 1991.

"Contamination Removal by $CO_2$ Jet Spray" by Ronald V. Peterson and Charles W. Bowers. SPIE vol. 1329 Optical System Contamination: Effects, Measurement, Control II (1990), pp. 72–85.

"$CO_2$ Jet Cleaning of IR Thin Film Coated Optics", Ronald C. Loveridge. Presented at Jul. 1991 SPIE Conference No. 16472 in San Diego, CA.

"Dry Surface Cleaning with $CO_2$ Snow" by Walter H. Whitlock. Presented at the 20th Annual Meeting of the Fine Particle Society in Boston, MA on Aug. 22, 1989.

"The removal of hydrocarbons and silicone grease stains from silicon wafers" by Robert Sherman and Walter Whitlock. J. Vac. Sci. Technol. B, vol. 8, No. 3, May/Jun. 1990.

"Dry Surface cleaning using $CO_2$ snow" by Robert Sherman, John Grob, and Walter Whitlock. J. Vac. Sci. Technol. B, vol. 9, No. 4, Jul./Aug. 1991.

"Dry Surface Cleaning Using Carbon Dioxide Snow" by R. Sherman. Proceedings of the 7th Electronic Materials and Processing Congress, Cambridge, MA, Aug. 24–27, 1992, pp. 155–159.

"Carbon Dioxide Snow Examination and Experimentation" by Elizabeth A. Hill. Precision Cleaning magazine, Feb. 1994, vol. II, No. 2.

"Carbon dioxide jet spray cleaning: mechanisms and risks" by Malina Hills. SPIE vol. 2261, pp. 324–333.

"Instruction Manual for $CO_2$ Snow Cleaning", Applied Surface Technologies, 15 Hawthorne Drive, New Providence, NJ 07974.

"Dry Surface Cleaning Using $CO_2$ Snow" by Robert Sherman. Society of Vacuum Coaters, 34th Annual Technical Conference Proceedings (1991), Mar. 17–22, 1991, Philadelphia, PA.

"Eliminate CFC Cleaning with Eco-Snow", Hughes Aircraft Company, 1993.

*Primary Examiner*—Peter A. Hruskoci
*Attorney, Agent, or Firm*—David M. Woods

[57] ABSTRACT

Apparatus and method are described for polishing a ductile metal surface, such as the gold surface of a mirror, by impacting the surface with a stream of microscopic particles of carbon dioxide from a jet spray nozzle at a velocity and duration sufficient to polish the surface.

12 Claims, 5 Drawing Sheets

CARBON DIOXIDE JET SPRAY POLISHING OF METAL SURFACES

This invention was made with Government support under contract number FA7056-92-C-0020 awarded by the Department of Defense. The Government has certain rights in this invention.

FIELD OF THE INVENTION

The invention relates generally to the field of optics, and in particular to the finishing of optical surfaces.

BACKGROUND OF THE INVENTION

For certain critical imaging applications, it is necessary to have highly reflecting metal surfaces (mirrors) to produce low-distortion images with high throughput efficiencies. Current methods of producing such surfaces include vacuum evaporation, sputtering, and chemical vapor deposition. Optical systems utilizing such surfaces can suffer from increased background noise caused by optical scatter. Considerable effort is spent to produce low scatter optical surfaces, including the use of high quality surface polishes, low scatter coatings, and stringent contamination control.

The use of carbon dioxide sprays for cleaning metal surfaces to remove both particulate and so-called "molecular film" contamination is well known. See, for example, the techniques described by R. C. Loveridge, in "$CO_2$ Jet Spray Cleaning of IR Thin Film Coated Optics, *Proceedings of SPIE*, CR 39 (Conference No. 16472), July 1991. More specifically, it is well known to use carbon dioxide sprays for cleaning optical mirrors such as those found in astronomical observatories. These sprays usually produce low-velocity, large carbon and typically cover expanses which are at least one square foot in area.

A second type of carbon dioxide particle delivery system which produces very fine (100 micrometers or less) particles at near super sonic velocities, so-called "jet spray" systems, have also been used to remove organic films and microscopic particles from a variety of surfaces, including mirrors. This technology is considered by most practitioners to be non-destructive and environmentally benign. Studies have shown, as pointed out in an article by R. V. Peterson and C. W. Bowers ("*Contamination Removal by $CO_2$ Jet Spray*", *SPIE* Vol. 1329 (1990) pp. 72–85), that $CO_2$ jet spray is a viable method for removing contaminants from optical surfaces with no damage to the surface.

A third type of carbon dioxide spray produces relatively large pellets of solid carbon dioxide in the size range of 500 micrometers to several millimeters. The primary uses of these sprays are the removal of paint and metal oxidation by abrasion of a surface in a fashion which is analogous to sand blasting with silicon dioxide particles. As part of the substrate surface is inevitably removed along with the coating and/or contamination, application of this technology often leads to visible roughening of the surface.

The current methods of depositing thin metal films for optical applications, including vacuum evaporation, sputtering, and chemical vapor deposition, produce surfaces with varying degrees of microscopic roughnesses, usually on the order to 10 to 100 Å rms. when measured with a scanning probe microscope. In addition, larger, long-range roughnesses can occur due to a variety of factors associated with the uniformity of the depositions. In a metal-surfaced mirror, the combination of these contributions to surface roughness will decrease the reflection efficiencies of the optic lead to diffuse scattering of light from such surfaces.

Following deposition, reflecting metal films are generally not subjected to further surface preparations, other than contamination removal, to increase their reflectivities. In fact, physical contact of the surfaces of such films with abrasives and clean room wipers generally results in decreases in reflectivities. Chemical and/or electrochemical polish-etching usually cannot be applied to thin metal films due to several factors including: 1) the extremely thin cross sections for such films (500 <→5000 Å); 2) the microscopic crystallite structure (density of films); and, 3) operationally, that such depositions are typically made on non-conducting substrates (e.g., fused silica, glass, and plastics). What is needed is a way of improving reflectivity of pristine surfaces (i.e., nominally clean surfaces) after deposition without causing surface damage.

SUMMARY OF THE INVENTION

The present invention is directed to overcoming one or more of the problems set forth above. We have discovered, contrary to the suggestions in the prior art, that when unprotected metal mirror surfaces produced by these technologies are treated with a jet of high velocity carbon dioxide particles, their intrinsic surface roughnesses are reduced resulting in concomitant increases in their reflectivities. Briefly summarized, according to one aspect of the present invention, the invention comprises a method of polishing a ductile metal surface comprising the step of impacting the surface with a stream of microscopic particles of carbon dioxide from a jet spray nozzle at a velocity and duration of sufficient magnitude that optical scatter measurements as obtained from a bi-directional reflectance distribution function show an increase in reflectivity over a substantially pristine condition of the surface.

The advantages of this treatment for improving the surface finish of a metal surface, such as a thin metal film, include:

1) direct physical contact of an optical surface with abrasives is eliminated;
2) $CO_2$ is chemically unreactive and does not leave a residue;
3) no physical or chemical waste is generated (environmentally green);
4) the polishing procedure is simple and robust;
5) the delivery system is portable and requires little maintenance; and
6) the hardware and consumables are relatively inexpensive.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

The use of the jet spray technology according to the invention involves the second type of carbon dioxide spray as described in the background of the invention. This type of carbon dioxide spray, hereafter referred to as $CO_2$ jet spray, is widely promoted as an alternative to solvent-based cleaning procedures. Reports, such as the aforementioned Loveridge, and Peterson et al papers, have previously appeared in the open literature describing the technology for these applications. These reports generally share the admonition that jet spray cleaning must be non-damaging to delicate precision surfaces, such as used in optical instruments. For example, the Loveridge paper expresses concern that $CO_2$ jet spray could damage delicate optical surfaces by directly impacting the surface or by dragging the particulate (contaminant) across the surface during the removal process. According to that paper, a study was done on such surfaces, including soft gold coated glass mirrors, and bi-directional reflectance distribution function (BRDF) scatter measurements verified that no damage was produced on any surface tested.

Surface modification induced by exposure to $CO_2$ jet sprays was mentioned in a report by M. Hills ("Carbon Dioxide Jet Spray Cleaning: Mechanisms and Risks," SPIE, 2261, 324 (1994)). In that work, however thin metal films of inconel were stripped from fused silica substrates by exposure to $CO_2$ jet sprays. Consequently, the use of a jet spray technique for surface polishing of metal optical surfaces is not only counter-intuitive, but against the general admonitions in the prior art. By thus operating in the face of prior art, it was found that exposure of thin, reflecting metal films with $CO_2$ jet sprays in post-deposition surface treatments produced a surface which is polished at near atomic scale dimensions. The reduction of surface roughness directly results in reduced light scatter from such treated surfaces, thus improving the performance of the optic (mirror).

Figure 1:
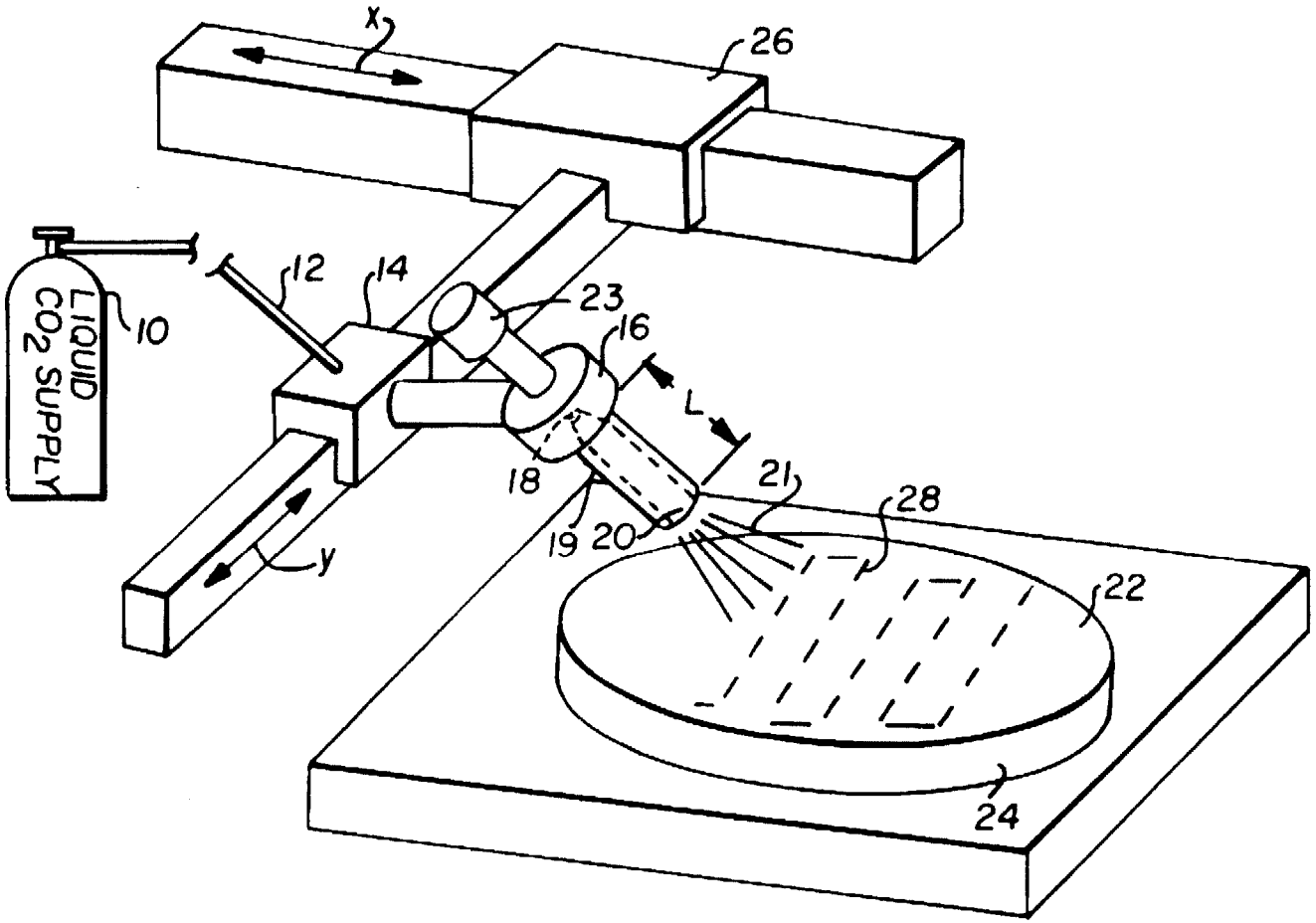
FIG. 1 is a drawing of a $CO_2$ jet spray delivery system as may be used to produce the results described by the present invention.

Referring now to the drawings, a mixture of $CO_2$ particles of random size and weight distributions, but generally not to exceed about 0.1 milligram each, is created by an apparatus as shown in FIG. 1. In its simplest form, the apparatus includes a pressurized siphon feed tank 10 of liquid $CO_2$ (about 800 psi), a transfer line 12, and a spray gun assembly 16 connected to the transfer line 12 through a supporting element 14. For $CO_2$ jet sprays, ultra-high purity grades of 99.99 or 99.999% (supercritical fluid or spectral grades) $CO_2$ are recommended to limit adventitious surface contamination by background organics during polishing.

Within the spray gun assembly 16, liquid $CO_2$is allowed to escape through an orifice 18. At the orifice, the liquid boils at atmospheric pressure forming gaseous $CO_2$. As the gas expands, the temperature within the nozzle near the orifice decreases, causing the gas to sublime to microscopic $CO_2$ particles. The spray gun assembly 16 includes a nozzle 19 having a nozzle opening 20 that shapes and directs the resulting solid/gas stream into a spray plume 21 that impacts upon a surface 22 of an optical workpiece 24, e.g., upon the reflective metal surface of a mirror. The velocity of the $CO_2$ spray, as well as the particle size, is a function of the ratio of the diameter of the orifice 18 to the diameter of the nozzle opening 20, and to the length l of the nozzle 19. The orifice diameter 18, and therefore the spray velocity, can be adjusted by means of a micrometercontrolled needle valve 23 in the spray gun assembly 16. Spray pressure (aggressiveness) increases with increasing micrometer setting (larger orifices) and decreasing nozzle diameter.

As shown in FIG. 1, the spray gun assembly 16 may be mounted for x–y translation on a carriage 26, which causes the solid/gas stream to trace a pattern 28 over the surface 22 of the workpiece 24 during the polishing operation. This type of mounting is suggested because the application time, or duration, of the $CO_2$ jet spray upon each area of the workpiece 24 is greater than the application time, or duration, of the $CO_2$ jet spray during jet spray cleaning. For cleaning, the $CO_2$ jet spray is typically hand-directed to each area of an optical surface for only a few seconds, e.g., 10 seconds. By contrast, the application time for $CO_2$ jet spray for polishing is more on the order of minutes, e.g., 1–5 minutes. This time differential makes hand application for polishing tiresome (though possible), and the use of a carriage assembly more desirable. (However, hand application is particularly feasible for $CO_2$ jet spray polishing of small workpieces that are substantially covered by the $CO_2$spray plume 21.)

The nozzle assembly 16 can be of commercial design as exemplified by the Hughes Aircraft Corporation's ECO-SNO™ $CO_2$ jet spray gun or any such similar system which is capable of delivering microscopic particles of $CO_2$ at near supersonic velocities. These devices can employ either single or double expansion type nozzles (although the $CO_2$ particles from a double expansion nozzle may be larger than is desired for polishing) and the nozzle material can be either metal or any of a number of engineering-type plastics which have been used in the fabrication of such apparatus.

Figure 2:
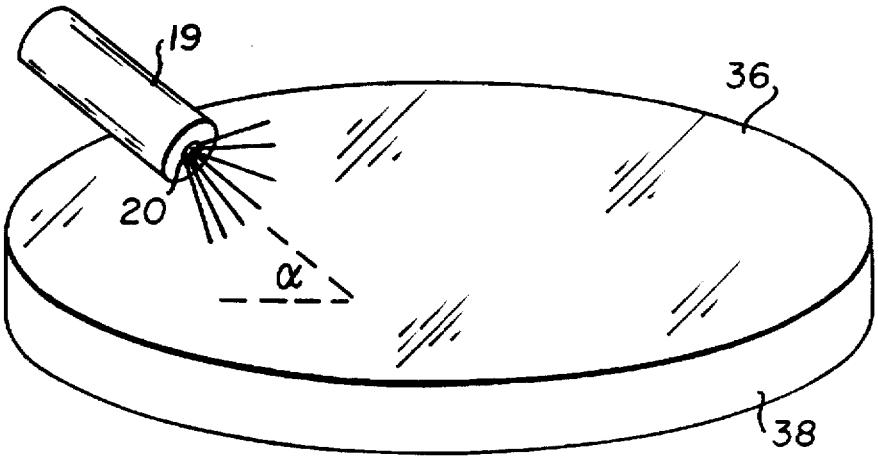
FIG. 2 is a schematic of the surface treatment procedure used to produce the results described by the present invention on a mirror.

A specific example of the $CO_2$ jet spray polishing technique is its use in polishing a vacuum-deposited thin film gold surface on an optical mirror. As shown in FIG. 2, application of the treatment to a thin film gold surface 36 of a mirror 38 involves impinging the $CO_2$ particles onto the mirror surface, preferably at an angle a between 30° and 90° with respect to the plane of the surface 36 of the mirror 38. At the surface 36, the pressure of the $CO_2$ gas/solid mixture should be in the range of 50 to 200 psi, with the ideal operating condition near 100 psi. (The surface pressure was measured with the spray plume impacting a conventional balance to determine the mass displacement per unit area of the plume.) In order to maximize the benefit of the treatment, the operation should be performed in a dry (less than 5% relative humidity) atmosphere, usually employing nitrogen or other chemically unreactive gas to displace ambient air.

Figure 3A:
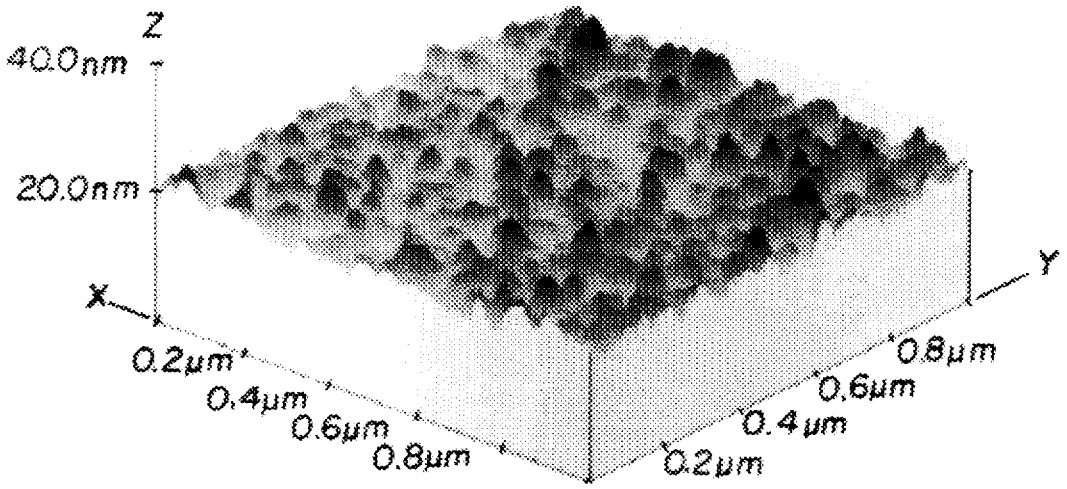
FIGS. 3*a* and 3*b* are (atomic force) microscopic surface photographs of typical gold surfaces taken before and after surface treatment using $CO_2$ jet spray.
Figure 3B:
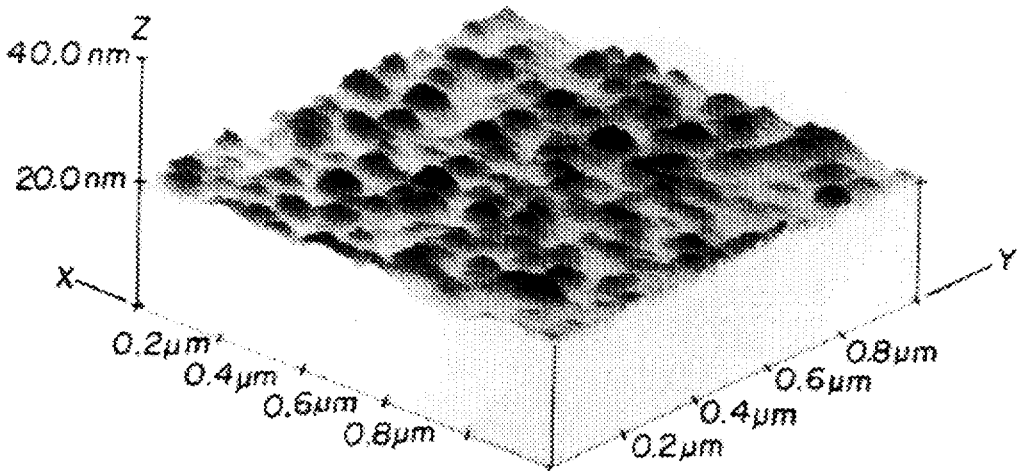

FIGS. 3*a* and 3*b* show the microscopic morphological effect of the treatment on an unprotected gold mirror surface. These micrographs were obtained using a Digital Instruments Nanoscope III Atomic Force Scanning Probe Microscope. As a result of the treatment, the RMS surface roughness in a 100 μm area of the vacuum-deposited gold thin film shown in FIG. 3 decreased from 1.174 nm to 1.043 nm. The decrease in surface roughness is generally on the order of 10–15%, which would be typical of other soft, unprotected metal surfaces treated under similar conditions.

Figure 4:
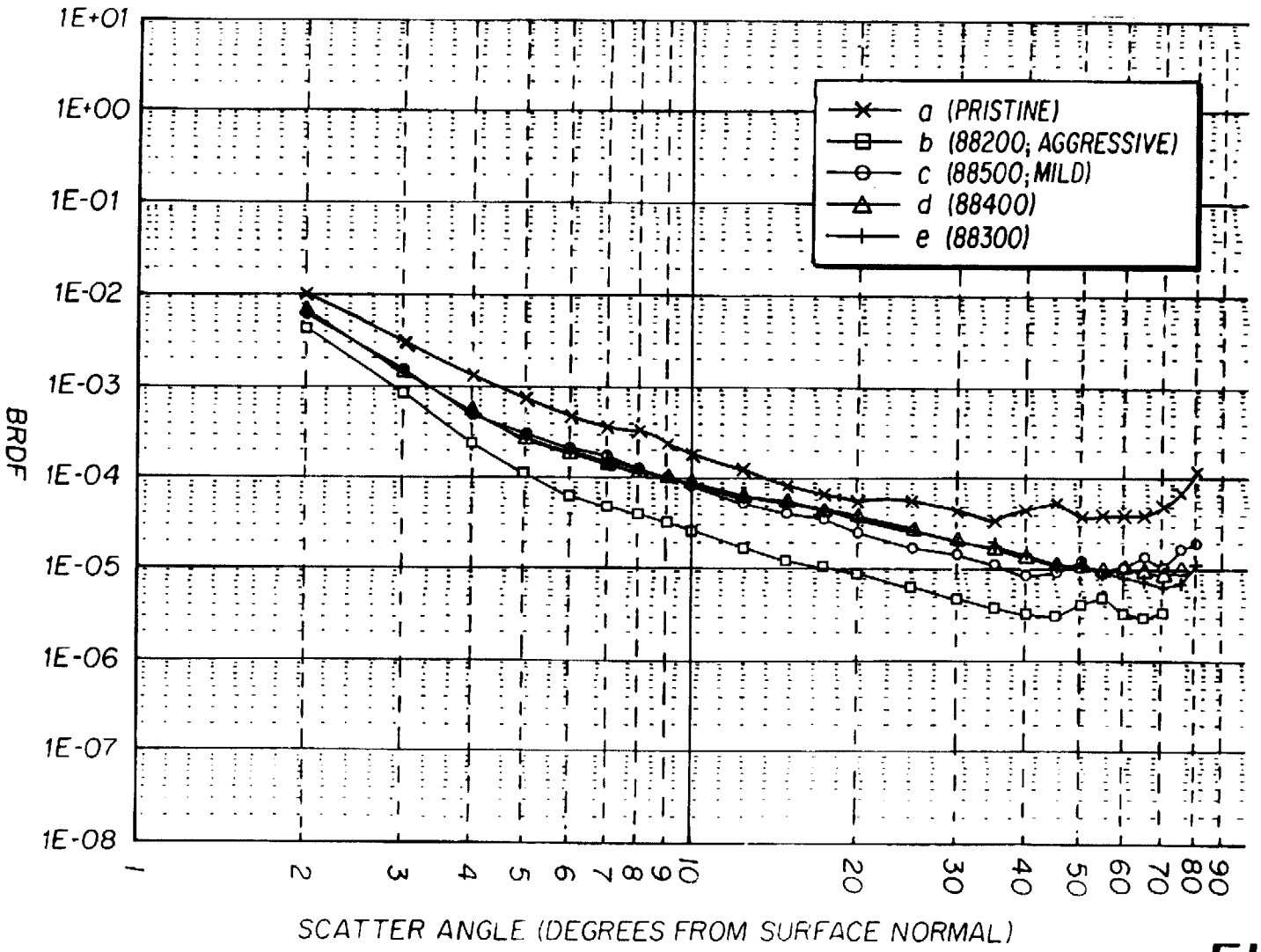
FIG. 4 shows the bi-directional reflection distribution function (BRDF) light scattering curves characterizing a gold-mirrored surface following the treatment described by the present invention.

Optical scatter is a measurable parameter directly related to the surface finish of the workpiece, and therefore to its reflectivity. A well known parameter used to measure optical scatter is the bi-directional reflectance distribution function (BRDF), which is the ratio of the reflected radiance to the incident irradiance. The procedure for this measurement is set forth in ASTM E1392-90, "Standard Practice for Angle Resolved Optical Scatter Measurements on Specular or Diffuse Surfaces," American Society for Testing and Materials, Philadelphia, Pa., Jan. (1991). All scatter measurements were made at a wavelength of 632.8 nm (Spectra Physics Model 124 He/Ne laser) at a fixed incident angle of 50 from the surface normal. For a performance proof of the efficacy of the treatment to decrease scatter and increase reflectivity, BRDF curves of a thin film gold mirror taken before and after $CO_2$ jet spray treatment with several different nozzles are shown in FIG. 4. Five minute exposures to each $CO_2$ jet spray condition, as provided by each nozzle, were performed in a dry $N_2$ clean box to avoid excessive condensation. More specifically, curve a refers to a pristine surface, for example, a surface that has been protected from contamination. While one would not expect obvious, visible contamination of the surface at this stage, room handling of the pristine surface leaves a certain small amount of contamination of the surface. Curves c, d, and e represent normal, but progressively more aggressive (higher velocity) $CO_2$ jet spray cleaning of the pristine surface to remove this small amount of contamination.

As shown in FIG. 4, the scatter results obtained for curves c, d and e are substantially the same, and the surface as thus cleaned, will be referred to hereinafter, including in the claims, as a substantially pristine surface. Such normal cleaning will remove dirt that reduces reflectivity. In addition to the improvement in reflectivity as a result of normal cleaning by $CO_2$ jet spray, FIG. 4 shows that at the most aggressive conditions as represented by the curve b, the total scatter from the gold surface decreases by approximately a factor of five over substantially pristine (clean gold) surfaces produced by the same procedure, but under less aggressive spray conditions.

Curves b, c, d, and e are based on use of four different nozzles commercially obtainable from Hughes Aircraft Corporation, as follows:

| Curve | Nozzle part number | Nominal nozzle diameter (mm) |
|---|---|---|
| b | 88200 | 1.5 |
| c | 88500 | 3.8 |
| d | 88400 | 3.0 |
| e | 88300 | 2.2 |

All nozzles measure 52.1 mm in length. Decreasing nozzle diameter causes increasing jet spray velocity, therefore becoming an increasingly aggressive treatment. Curves c, d, and e were found, as described above, to represent normal cleaning by $CO_2$ jet spray, and provided some increase in reflectivity due to removal of contamination even from a nominally pristine surface. However, a markedly different result is shown in curve b, which uses the smallest nozzle diameter (1.5 mm) for the most aggressive treatment. As confirmed by the photographs of FIG. 3, total scatter is substantially decreased (reflectivity is increased) by the $CO_2$ jet spray actually reducing the surface roughness of the thin film gold surface. For the particular nozzles used, it is apparent that the use of nozzles with diameter below about 2.2 mm would be expected to produce a polishing result.

It is expected that this polishing technique would work effectively with other metal surfaces, particularly with ductile metals that do not form passivating oxide layers. Such preferred surfaces, besides gold, would include platinum, iridium, silver, and other noble metals. Aluminum and beryllium, which do form oxide layers, do not respond as well as the preferred surfaces, but to the extent some improvement is observed, treatment of aluminum and beryllium according to the invention are not to be excluded from the claims. Similarly, copper is not expected to respond as well as the preferred metals, but may nonetheless realize some improvement.

Figure 5:
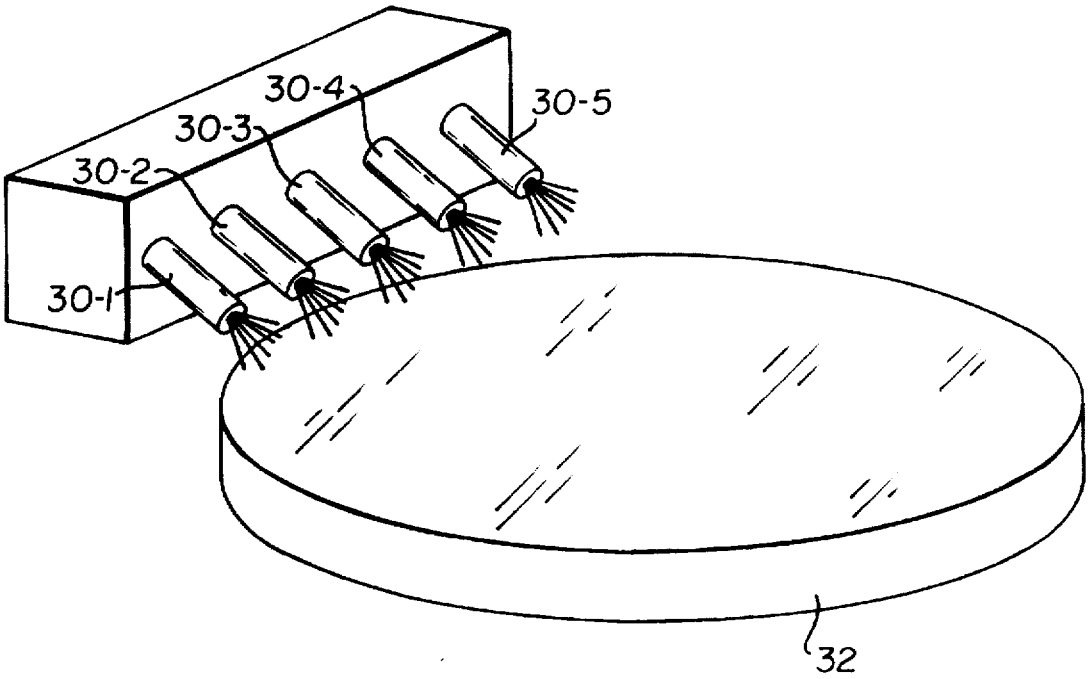
FIG. 5 is a schematic of a multiple head (array) of $CO_2$ jet spray nozzles for polishing large optical surfaces.

The apparatus can also incorporate multiple nozzles 30-1 to 30-5 each of a similar type to cover a large area optical workpiece shown as in FIG. 5. The nozzles 30-1 to 30-5 are supported from a manifold 34, which would typically be mounted for translation over the workpiece 32 by a carriage such as shown in FIG. 1 (carriage 26). This configuration is particularly useful for polishing large optical mirror surfaces.

The invention has been described with reference to a preferred embodiment. However, it will be appreciated that variations and modifications can be effected by a person of ordinary skill in the art without departing from the scope of the invention.

| PARTS LIST | |
|---|---|
| 10 | tank of $CO_2$ |
| 12 | transfer line |
| 14 | supporting element |
| 16 | spray gun assembly |
| 18 | orifice |
| 19 | nozzle |
| 20 | nozzle opening |
| 21 | spray plume |
| 22 | surface |
| 23 | needle valve |
| 24 | workpiece |
| 26 | carriage |
| 28 | pattern |
| 30-1 to 30-5 | multiple nozzles |
| 32 | large area optical workpiece |
| 34 | manifold |
| 36 | thin film surface |
| 38 | mirror |

We claim:

1. A method of polishing a ductile metal surface comprising the step of impacting the surface with a stream of microscopic particles of carbon dioxide from a jet spray nozzle at a velocity and duration of sufficient magnitude that bi-directional reflectance distribution function scatter measurements show a decrease in scatter and an increase in reflectivity over a substantially pristine condition of the surface, wherein the duration of application of the stream of particles exceeds one minute for each area of the surface.

2. The method as claimed in claim 1, wherein the particles of carbon dioxide are from 0.1 μm to 500 μm in equivalent circular diameter.

3. The method as claimed in claim 1, wherein the particles are emitted from a nominally 1.5 mm diameter jet spray nozzle.

4. The method as claimed in claim 1 wherein the jet spray nozzle has an orifice suitable for producing carbon dioxide particles in size range from 0.1 μm to 500 μm in equivalent circular diameter at a pressure between 50 to 200 psi as measured at the metal surface.

5. The method as claimed in claim 1 wherein the ductile metal surface is a material selected from the group consisting of gold, platinum, iridium, and silver.

6. A method of polishing a ductile metal surface comprising the step of impacting the surface with a stream of microscopic particles of carbon dioxide from a jet spray nozzle of a nominal diameter of less than 2.2 mm for a duration of greater than one minute, wherein said surface has an increase in reflectivity over a substantially pristine condition of said surface.

7. The method claimed in claim 6, wherein the particles of carbon dioxide are from 0.1 μm to 500 μm in equivalent circular diameter.

8. The method claimed in claim 7, wherein the jet spray nozzle is equipped with an orifice suitable for producing carbon dioxide particles in size range as declared in claim 7 at a pressure between 50 to 200 psi as measured at the metal surface.

9. A method of polishing a ductile metal surface comprising the steps of:

providing a carbon dioxide jet spray from a jet spray nozzle;

impacting the surface with a stream of microscopic particles of carbon dioxide from the jet spray; and moving the jet spray nozzle over the workpiece so each area of the workpiece is impacted with particles for at least one minute, wherein said surface has an increase in reflectivity over a substantially pristine condition of said surface.

10. The method as claimed in claim 9, wherein the particles of carbon dioxide are from 0.1 μm to 500 μm in equivalent circular diameter.

11. The method as claimed in claim 9, wherein the particles are emitted from a nominally 1.5 mm diameter jet spray nozzle.

12. The method as claimed in claim 9 wherein the jet spray nozzle has an orifice suitable for producing carbon dioxide particles in size range from 0.1 μm to 500 μm in equivalent circular diameter at a pressure between 50 to 200 psi as measured at the metal surface.

* * * * *

UNITED STATES PATENT AND TRADEMARK OFFICE

CERTIFICATE OF CORRECTION

PATENT NO. : 5,765,578
DATED : June 16, 1998
INVENTOR(S) : Elwood Steven Brandt, et al.

It is certified that error appears in the above-identified patent and that said Letters Patent is hereby corrected as shown below:

On the title page:

--Related U.S. Application Data
[60] Provisional application No. 60/003,654, Sept. 15, 1995--.

Column 1, line 3, insert the following:

--CROSS REFFERENCE TO RELATED APPLICATION
Reference is made to and priority claimed from U.S. Provisional application Ser. No. US60/003,654, filed Sept. 15, 1995, entitled CARBON DIOXIDE JET SPRAY POLISHING OF METAL SURFACES--.

Signed and Sealed this

First Day of September, 1998

Bruce Lehman

*Attest:*

BRUCE LEHMAN

*Attesting Officer*

*Commissioner of Patents and Trademarks*